US011059694B2

(12) United States Patent
Poulin et al.

(10) Patent No.: US 11,059,694 B2
(45) **Date of Patent: *Jul. 13, 2021**

(54) ELECTRIC CABLE REEL

(71) Applicant: NEXANS, Courbevoie (FR)

(72) Inventors: Nicolas Poulin, Auchy les Mines (FR); Olivier Pinto, Francheville (FR)

(73) Assignee: NEXANS, Courbevoie (FR)

( * ) Notice: Subject to any disclaimer, the term of this patent is extended or adjusted under 35 U.S.C. 154(b) by 154 days.

This patent is subject to a terminal disclaimer.

(21) Appl. No.: 16/347,294

(22) PCT Filed: Oct. 26, 2017

(86) PCT No.: PCT/FR2017/052950

§ 371 (c)(1),
(2) Date: May 3, 2019

(87) PCT Pub. No.: WO2018/087449

PCT Pub. Date: May 17, 2018

(65) Prior Publication Data

US 2019/0284018 A1 Sep. 19, 2019

(30) Foreign Application Priority Data

Nov. 9, 2016 (FR) ..... 16 60822

(51) Int. Cl.
*B65H 75/44* (2006.01)

(52) U.S. Cl.
CPC ..... *B65H 75/4484* (2013.01); *B65H 2701/34* (2013.01)

(58) Field of Classification Search
CPC . B65H 75/4484; B65H 2701/34; H02G 11/02
See application file for complete search history.

(56) References Cited

U.S. PATENT DOCUMENTS 4,236,449 A * 12/1980 Price ..... B65H 26/00 101/228
4,537,364 A * 8/1985 Pollman ..... B65H 75/425 242/390.9
5,395,065 A * 3/1995 Hirose ..... A01K 89/015 242/223
5,967,445 A * 10/1999 Yuyama ..... B65H 16/04 242/421.1
6,354,528 B1 * 3/2002 Nagata ..... B60R 22/405 242/374
9,050,527 B2 * 6/2015 Loose ..... G07F 17/3202
(Continued)

FOREIGN PATENT DOCUMENTS

DE 20 2013 104456 10/2013
EP 2 112 286 10/2009
JP H11 11798 A 1/1999

OTHER PUBLICATIONS

International Search Report dated Jan. 25, 2018.

*Primary Examiner* — William A. Rivera
(74) *Attorney, Agent, or Firm* — Sofer & Haroun, LLP

(57) ABSTRACT

The invention relates to an electrical cable reel. According to the invention, the reel comprises an arrangement (4) for remotely monitoring the amount of cable wound around the reel, said arrangement comprising a sensor (4A) and an electronic board connected to the sensor and linked to a remote application that is enabled.

8 Claims, 1 Drawing Sheet

(56) References Cited

U.S. PATENT DOCUMENTS

| | | | | |
|---|---|---|---|---|
| 2005/0077413 | A1* | 4/2005 | Nakagawa | E04G 21/123 242/422.4 |
| 2009/0283167 | A1* | 11/2009 | Nakagawa | E04G 21/123 140/111 |
| 2012/0056966 | A1* | 3/2012 | Maruyama | B65H 16/06 347/221 |
| 2014/0061351 | A1 | 3/2014 | Maruyama | |
| 2015/0252538 | A1* | 9/2015 | Muratov | E01C 19/522 404/99 |
| 2016/0023863 | A1* | 1/2016 | Martin | G01D 5/3473 242/563.2 |
| 2018/0023354 | A1* | 1/2018 | Dion | E21B 19/22 166/363 |
| 2019/0367320 | A1* | 12/2019 | Abbiati | B65H 75/182 |

* cited by examiner

ELECTRIC CABLE REEL

RELATED APPLICATION

This application is a National Phase of PCT/FR2017/052950, filed on Oct. 26, 2017, which claims the benefit of priority from French Patent Application No. 16 60822, filed on Nov. 9, 2016, the entirety of which are incorporated by reference.

BACKGROUND

Field of the Invention

The invention relates to a reel for an electric cable.

Description of Related Art

Currently, no reel for an electric cable allows automatic monitoring of the quantity of cable wound on the reel.

However, it may be very useful for the user or owner of the reel to check the presence and quantity of available electric cable in order, among other things, to manage his stock of cable or to place an order quickly when this stock runs out.

OBJECTS AND SUMMARY

The invention solves this problem.

More specifically, the invention proposes a reel for an electric cable of electric cable, characterized in that it has an arrangement for remote monitoring of the quantity of cable wound on the reel, having a sensor and an electronic board connected to said sensor and linked to an active remote application.

Preferably, said sensor is carried by at least one of the flanges of the reel.

Advantageously, said sensor is incorporated into the inner face of at least one of the flanges of the reel.

According to one preferred embodiment, said sensor is an ultrasonic sensor.

In a variant, said sensor may be an LED sensor.

Preferably, said sensor has an ultrasound emitter and an associated ultrasound receiver, the ultrasonic beam emitted by said emitter being able to be reflected by the external surface of the cable wound on the drum of the reel.

Advantageously, said sensor is housed in a cavity arranged close to the outer edge of said flange.

Preferably, said sensor is oriented toward the drum of the reel and disposed on a surface that is inclined by an angle of between 10 and 80 degrees, preferably substantially equal to 10 degrees, with respect to the axis of rotation of the reel.

Advantageously, the reel is also equipped with a geolocation arrangement.

BRIEF DESCRIPTION OF THE DRAWINGS

The invention is described in more detail below with the aid of figures that show only a preferred embodiment of the invention.

DETAILED DESCRIPTION

Figure 1:
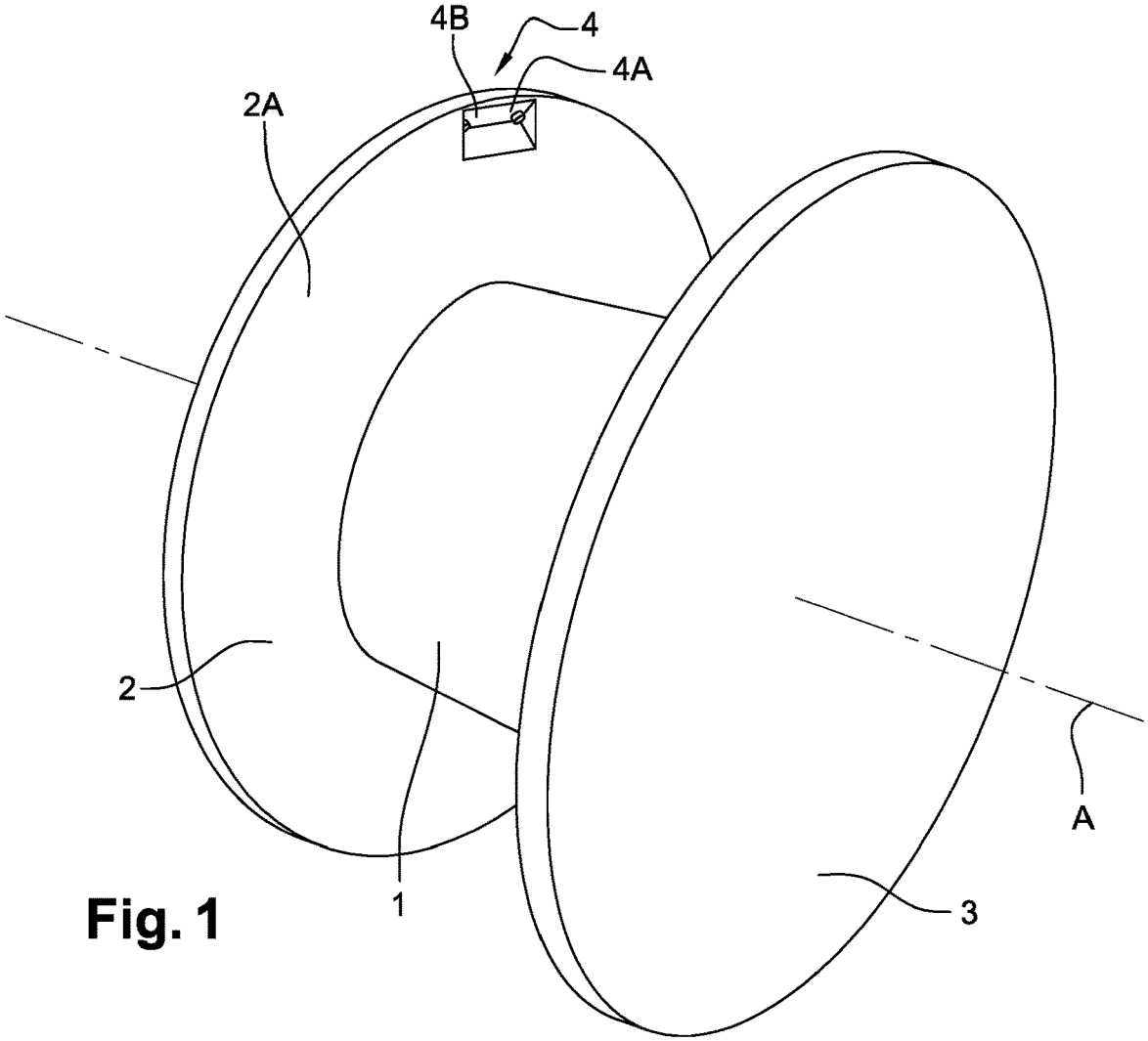
FIG. 1 is a perspective view of a reel according to the invention.
Figure 2:
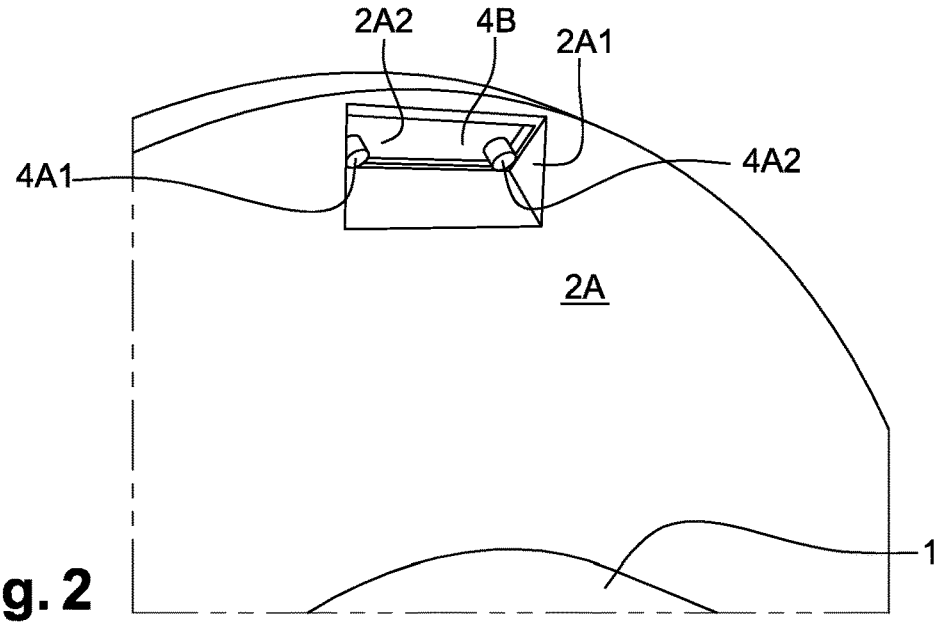
FIG. 2 is a perspective detail view of a reel according to the invention.

As shown in the figures, a reel for an electric cable conventionally has a drum 1 about which a cable is intended to be wound, and two lateral flanges 2, 3.

According to the invention, it has an arrangement 4 for remote monitoring of the quantity of cable wound on the reel, having a sensor 4A incorporated in the inner face 2A of at least one of the flanges 2 of the reel and an electronic board connected to the sensor and linked to an active remote application.

This electronic board is contained in a housing 4B adjacent to the sensor 4A and comprises an arrangement for monitoring the state of the battery.

Preferably, this sensor 4A is an ultrasonic sensor and has an ultrasound emitter 4A1 and an associated ultrasound receiver 4A2, the ultrasonic beam emitted by the emitter 4A1 being able to be reflected by the external surface of the cable wound on the drum 1 of the reel.

It is thus possible to calculate the distance between the sensor 4A and the external surface of the cable wound on the drum 1 and to infer the quantity of wound cable therefrom.

This quantity of cable can easily be converted into length of cable, either by practice-based calibration or by calculating this length as a function of the diameter of the cable and that of the drum of the reel.

Preferably, the value of this distance and/or of the quantity of cable wound on the reel is transmitted to the remote application at a certain frequency.

This remote application is preferably an application connected to a mobile network, in particular GSM (acronym for "Global System for Mobile Communications") or SIGFOX.

To allow the management of a set of such reels, each reel advantageously has an electronic identification number.

The sensor 4A is housed in a cavity 2A1 arranged close to the outer edge 2B of the flange, is oriented toward the drum 1 of the reel and disposed on a surface 2A2 of the cavity that is inclined by an angle of between 10 and 80 degrees with respect to the axis of rotation (A) of the reel, depending on the dimensions of the flanges and of the drum. Preferably, this inclination angle is around 10 degrees.

The reel may also be equipped with a geolocation arrangement, ensuring the remote knowledge of the location of each reel, at the same time as the quantity of cable wound on each reel. It is thus much easier to manage stocks of reels by giving a user who needs a certain length of cable the reference and the position of the reels that can provide him with this quantity of cable while optimizing his route thereto.

The invention claimed is:

1. An electric cable reel comprising:

an arrangement for remote monitoring of the quantity of cable wound on the reel, having a sensor; and an electronic board connected to said sensor and linked to an active remote application, wherein said sensor is carried by at least one flange of the reel.

2. The reel as claimed in claim 1, wherein sensor is incorporated into the inner face of at least one of the flanges of the reel.

3. The reel as claimed in claim 1, wherein said sensor is an ultrasonic sensor.

4. The reel as claimed in claim 1, wherein said sensor has an ultrasound emitter and an associated ultrasound receiver, the ultrasonic beam emitted by said emitter being able to be reflected by the external surface of the cable wound on the drum of the reel.

5. The reel as claimed in claim 1, wherein said sensor is housed in a cavity arranged close to the outer edge of said flange.

6. The reel as claimed in claim 1, wherein said sensor is oriented toward the drum of the reel and disposed on a surface that is inclined by an angle of between 10 and 80 degrees with respect to the axis of rotation of the reel.

7. The reel as claimed in claim 6, wherein said angle is substantially equal to 10 degrees.

8. The reel as claimed in claim 1, wherein said reel is also equipped with a geolocation arrangement.

* * * * *